US011101579B2

(12) United States Patent
Nishijima

(10) Patent No.: US 11,101,579 B2
(45) Date of Patent: Aug. 24, 2021

(54) SPRING BIASED FEMALE TERMINAL

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Seido Nishijima, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/970,277

(22) PCT Filed: Feb. 15, 2019

(86) PCT No.: PCT/JP2019/005641
§ 371 (c)(1),
(2) Date: Aug. 14, 2020

(87) PCT Pub. No.: WO2019/171914
PCT Pub. Date: Sep. 12, 2019

(65) Prior Publication Data

US 2021/0143561 A1 May 13, 2021

(30) Foreign Application Priority Data

Mar. 8, 2018 (JP) ..... JP2018-042166
May 7, 2018 (JP) ..... JP2018-089453

(51) Int. Cl.
*H01R 13/193* (2006.01)
*H01R 13/20* (2006.01)
(Continued)

(52) U.S. Cl.
CPC ..... *H01R 4/4863* (2013.01); *H01R 13/193* (2013.01); *H01R 13/20* (2013.01); *H01R 13/2421* (2013.01); *H01R 13/5045* (2013.01)

(58) Field of Classification Search
CPC .... H01R 4/4863; H01R 13/193; H01R 13/20; H01R 13/2421; H01R 13/5045; H01R 13/111
See application file for complete search history.

(56) References Cited

U.S. PATENT DOCUMENTS 3,008,114 A * 11/1961 Adkins ..... H01R 11/286 439/224
5,588,883 A 12/1996 Hattori
(Continued)

FOREIGN PATENT DOCUMENTS

JP S49-028186 U 3/1974
JP H07-335193 A 12/1995
(Continued)

OTHER PUBLICATIONS

May 7, 2019 International Search Report issued in International Patent Application No. PCT/JP2019/005641.

*Primary Examiner* — Vanessa Girardi
(74) *Attorney, Agent, or Firm* — Oliff PLC

(57) ABSTRACT

A female terminal, including: a female terminal fitting including a connector to be conductively connected to a male terminal; a male terminal inserting tube provided in the female terminal fitting, the male terminal being press-fit into the male terminal inserting tube, the male terminal inserting tube forming the connector by an inner surface; a pair of overlapping plates connected to a pair of first divided portions provided by dividing the male terminal inserting tube over an entire length in an axial direction at one position in a circumferential direction, the pair of overlapping plates being separated from each other and projecting
(Continued)

outward; and a spring held on the female terminal fitting, the spring holding the male terminal inserting tube in a reduced diameter state by biasing the pair of overlapping plates in a direction to overlap the pair of overlapping plates on each other.

13 Claims, 8 Drawing Sheets

(51) Int. Cl.

| | |
|---|---|
| ***H01R 4/48*** | (2006.01) |
| ***H01R 13/504*** | (2006.01) |
| ***H01R 13/24*** | (2006.01) |

(56) References Cited

U.S. PATENT DOCUMENTS

| | | | | |
|---|---|---|---|---|
| 6,062,918 | A * | 5/2000 | Myer | H01R 13/187 439/833 |
| 6,293,833 | B1 * | 9/2001 | Kamath | H01R 13/113 439/839 |
| 9,748,685 | B2 * | 8/2017 | Oba | H01R 4/183 |
| 10,418,740 | B2 | 9/2019 | Kimura et al. | |
| 2020/0403342 | A1 * | 12/2020 | Nishijima | H01R 13/193 |

FOREIGN PATENT DOCUMENTS

| | | | |
|---|---|---|---|
| JP | H08-050892 | A | 2/1996 |
| JP | 2011-238558 | A | 11/2011 |
| JP | 2017-183270 | A | 10/2017 |
| KR | 10-2006-0064770 | A | 6/2006 |

* cited by examiner

SPRING BIASED FEMALE TERMINAL

BACKGROUND

The present disclosure relates to a female terminal and, particularly, to a female terminal capable of conductive connection to a male terminal with a large contact pressure.

Conventionally, a female terminal with a box-shaped case including an opening in a side edge part and a pair of deflectable and deformable connecting portions projecting into the case, for example, described in Japanese Unexamined Patent Publication No. 2011-238558 is known as a female terminal to be used in an electric system of an automotive vehicle or the like. As shown in FIG. 8 of Japanese Unexamined Patent Publication No. 2011-238558, this female terminal is configured such that a male terminal and the connecting portions of the female terminal are electrically connected with a large contact pressure by mounting a separate spring member for applying a biasing force in an approaching direction to the pair of connecting portions after the male terminal is inserted into the case through the opening.

SUMMARY

However, in such a female terminal having a conventional structure, since the separate spring member needs to be mounted after the male terminal is inserted into the case through the opening, a working process increases and workability may be deteriorated. Accordingly, it is, for example, considered to apply a large biasing force in the approaching direction to the pair of connecting portions in advance. However, in this case, an insertion force when the male terminal is inserted into between the pair of connecting portions of the case through the opening increases, wherefore insertion may become difficult or the case of the female terminal and the male terminal may be damaged during insertion.

In addition, when a certain external force is applied to the male terminal or the female terminal, the external force is transmitted in a resilient deformation direction of the spring member. Thus, the contact pressure between the connecting portions of the female terminal and the male terminal may vary.

An exemplary aspect of the disclosure provides a female terminal having a novel structure and capable of reducing an insertion force, facilitating an operation and suppressing a variation of a contact pressure while securing a large contact pressure between the male and female terminals.

The present disclosure is directed to a female terminal with a female terminal fitting including a connector to be conductively connected to a male terminal, a male terminal inserting tube provided in the female terminal fitting, the male terminal being press-fit into the male terminal inserting tube, the male terminal inserting tube forming the connector by an inner surface, a pair of overlapping plates connected to a pair of first divided portions provided by dividing the male terminal inserting tube over an entire length in an axial direction at one position in a circumferential direction, the pair of overlapping plates being separated from each other and projecting outward, and a spring held on the female terminal fitting, the spring holding the male terminal inserting tube in a reduced diameter state by biasing the pair of overlapping plates in a direction to overlap the pair of overlapping plates on each other, a force in a diameter reducing direction being applied to the male terminal inserting tube by a biasing force of the spring, the male terminal inserting tube being resiliently deformed in a diameter expanding direction against the biasing force of the spring to allow the male terminal to be press-fit into the male terminal inserting tube when the male terminal is press-fit into the male terminal inserting tube.

According to the present disclosure, the connector configured by the inner surface of the male terminal inserting tube can be pressed into contact with the male terminal press-fit into the male terminal inserting tube with a large contact pressure. Further, a high contact pressure between the male and female terminals can be realized by excellent workability. In addition, a variation of the contact pressure between the male and female terminals due to an external force can be advantageously reduced or prevented.

DETAILED DESCRIPTION OF EMBODIMENTS

Figure 1:
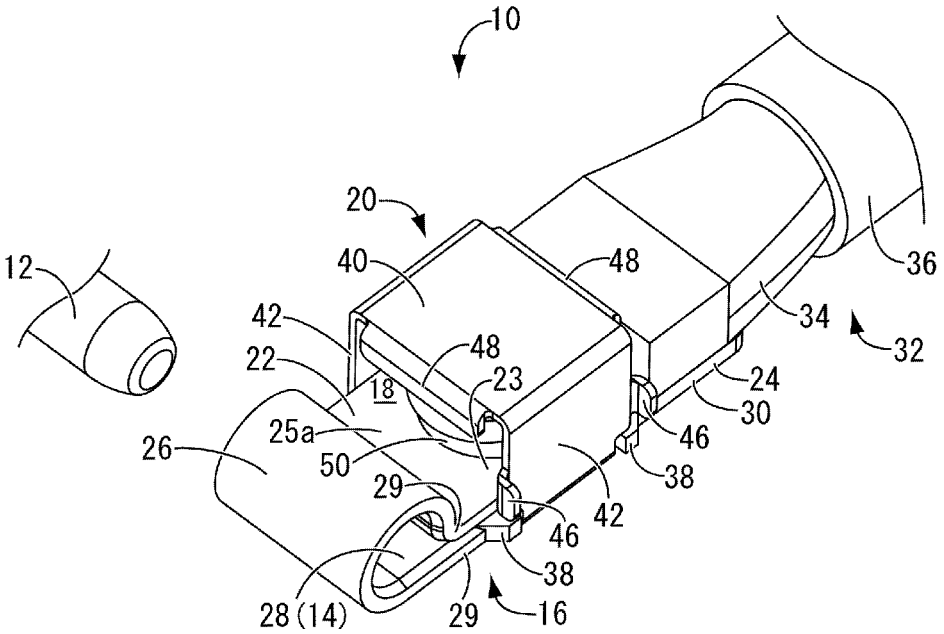
FIG. 1 is an overall perspective view showing a female terminal as a first embodiment of the present disclosure.

First, embodiments of the present disclosure are listed and described.

A first aspect of the present disclosure is directed to a female terminal with a female terminal fitting including a connecting portion to be conductively connected to a male terminal, a male terminal inserting tube portion provided in the female terminal fitting, the male terminal being press-fit into the male terminal inserting tube portion, the male terminal inserting tube portion constituting the connecting portion by an inner surface, a pair of overlapping plate portions connected to a pair of first divided portions provided by dividing the male terminal inserting tube portion over an entire length in an axial direction at one position in a circumferential direction, the pair of overlapping plate portions being separated from each other and projecting outward, and a biasing means held on the female terminal fitting, the biasing means holding the male terminal inserting tube portion in a reduced diameter state by biasing the pair of overlapping plate portions in a direction to overlap the pair of overlapping plate portions on each other, a force in a diameter reducing direction being applied to the male terminal inserting tube portion by a biasing force of the biasing means, the male terminal inserting tube portion being resiliently deformed in a diameter expanding direction against the biasing force of the biasing means to allow the male terminal to be press-fit into the male terminal inserting tube portion when the male terminal is press-fit into the male terminal inserting tube portion.

According to the female terminal of this aspect, the male terminal inserting tube portion provided in the female terminal fitting includes the pair of first divided portions divided over the entire length in the axial direction at the one position in the circumferential direction and the pair of overlapping plate portions connected to the first divided portions, separated from each other and projecting outward. The pair of overlapping plate portions are biased in a direction to approach and overlap on each other by the biasing means held on the female terminal fitting. In this way, the pair of first divided portions of the male terminal inserting tube portion are resiliently deformed in a direction to approach and overlap on each other, and the male terminal inserting tube portion is held in the reduced diameter state by the biasing force of the biasing means. Moreover, since the male terminal inserting tube portion is resiliently deformable in the diameter expanding direction against the biasing force when the male terminal is press-fit into the male terminal inserting tube portion, the male terminal is allowed to be press-fit into the male terminal inserting tube portion. In the female terminal of this aspect having such a structure, a force in a diameter reducing direction is applied to the male terminal inserting tube portion by the biasing force of the biasing means. Therefore, the connecting portion configured by the inner surface of the male terminal inserting tube portion can be pressed into contact with the male terminal press-fit into the male terminal inserting tube portion with a large contact pressure.

Further, since the biasing means is held on the female terminal fitting, it is not necessary to mount a separate spring member or the like to sandwich a conductive connection part after the male terminal is conductively connected to the female terminal like a conventional structure. Therefore, a working process can be simplified and a high contact pressure between the male and female terminals can be realized by excellent workability.

Further, when the male terminal is press-fit into the male terminal inserting tube portion, the male terminal inserting tube portion is allowed to be resiliently deformed in the diameter expanding direction against the biasing force of the biasing means. Therefore, it is possible to stably maintain a press-contact state while advantageously reducing an insertion force in inserting the male terminal toward the connecting portion of the female terminal.

In addition, if a certain external force is applied to the male terminal, the external force is transmitted in a radially outward direction of the male terminal inserting tube portion. Thus, a transmitting direction of the external force is made different from an overlapping direction, which is a biasing direction of the pair of overlapping plate portions by the biasing means. Therefore, it is possible to advantageously reduce or prevent a variation of the contact pressure between the male and female terminals due to the external force transmitted to the male terminal and ensure an improvement of conduction stability between the male and female terminals.

A second aspect of the present disclosure is such that, in the female terminal according to the first aspect, the female terminal fitting includes a strip-like flat metal plate, one end part in a longitudinal direction of the flat metal plate constituting one of the pair of overlapping plate portions is folded toward another end part and overlapped on the other of the pair of overlapping plate portions provided on the side of the other end part, whereby an intermediate part in the longitudinal direction of the flat metal plate is curved to provide the male terminal inserting tube portion.

According to this aspect, the female terminal fitting includes the pair of first divided portions divided over the entire length in the axial direction of the male terminal inserting tube portion at the one position in the circumferential direction of the male terminal inserting tube portion and the pair of overlapping plate portions connected to the first divided portions, separated from each other and projecting outward. Therefore, the female terminal fitting provided with the male terminal inserting tube portion can be easily manufactured with a good yield by a simple structure of folding the one end part of the strip-like flat metal plate toward the other end part.

A third aspect of the present disclosure is such that, in the female terminal according to the second aspect, the other end part of the flat metal plate constituting the female terminal fitting serves as a wire connecting portion, and the biasing means for biasing the pair of overlapping plate portions in an approaching direction is disposed and held between the wire connecting portion and the male terminal inserting tube portion.

According to this aspect, the other end part of the flat metal plate serves as the wire connecting portion, and a separation distance of the male terminal inserting tube portion from the wire connecting portion is secured by disposing and holding the biasing means between the wire connecting portion and the male terminal inserting tube portion. In this way, the male terminal inserting tube portion can be advantageously protected from thermal effect when a core exposed on an end of an external wire is connected and fixed to the wire connecting portion by welding or the like, and influences and the like on plating properties by thermal effect can be reduced or avoided.

A fourth aspect of the present disclosure is such that, in the female terminal according to the first aspect, the female terminal fitting further includes second divided portions extending over the entire length in the axial direction and a pair of extending plate portions connected to the second divided portions and projecting outward at another position in the circumferential direction of the male terminal inserting tube portion, and the pair of extending plate portions are overlapped on each other to configure a wire connecting portion.

According to this aspect, the pair of extending plate portions extending from the second divided portions provided in the male terminal inserting tube portion are overlapped on each other, whereby the wire connecting portion is provided. In this way, the pair of extending plate portions extending from both of the pair of second divided portions can serve as current paths, and a cross-sectional area of the wire connecting portion configured by overlapping the pair of extending plate portions on each other can be advantageously secured. As a result, more current can flow and, even if a plate thickness of the male terminal inserting tube portion is reduced, a large cross-sectional area of the wire connecting portion can be secured. Therefore, a large conductor cross-sectional area can be secured while an insertion force of the male terminal into the male terminal inserting tube portion is reduced by reducing the plate thickness of the male terminal inserting tube portion and facilitating resilient deformation of the male terminal inserting tube portion.

Note that the circumferential positions of the second divided portions provided in the male terminal inserting tube portion can be arbitrarily set according to conditions such as a disposed region of the female terminal. For example, the second divided portions may be provided at positions facing the first divided portions in a direction perpendicular to the axial direction of the male terminal inserting tube portion or the first divided portions and the second divided portions may be provided at positions separated by 90° in the circumferential direction of the male terminal inserting tube portion and the overlapping plate portions and the extending plate portions may be configured to project in directions orthogonal to each other.

A fifth aspect of the present disclosure is such that, in the female terminal according to the fourth aspect, the male terminal inserting tube portion is provided between the wire connecting portion and the pair of overlapping plate portions in the longitudinal direction of the female terminal fitting.

According to this aspect, the wire connecting portion and the pair of overlapping plate portions are provided on both sides across the male terminal inserting tube portion in the female terminal fitting. In this way, it is not necessary to dispose the biasing means for biasing the pair of overlapping plate portions between the connecting portion to be pressed into contact with the male terminal and the wire connecting portion, and a current path between the connecting portion of the female terminal and the wire connecting portion can be shortened. Therefore, conductor resistance can also be reduced and performances of the female terminal can be improved.

A sixth aspect of the present disclosure is such that, in the female terminal according to the fourth or fifth aspect, the female terminal fitting includes a first plate fitting integrally configuring one of the pair of overlapping plate portions connected to one of the first divided portions, a peripheral wall of the male terminal extending from the one of the first divided portions to one of the second divided portions and one of the extending plate portions extending from the one of the second divided portions, and a second plate fitting including the other of the pair of overlapping plate portions connected to the other of the first divided portions, the peripheral wall of the male terminal inserting tube portion extending from the other of the first divided portions to the other of the second divided portions and the other of the extending plate portions extending from the other of the second divided portions, the first and second plate fittings are overlapped on each other to configure the male terminal inserting tube portion in central parts in the longitudinal direction of the first and second plate fittings, the wire connecting portion is configured on a base end side in the longitudinal direction, and the biasing means for overlapping the pair of overlapping plate portions on each other and biasing the pair of overlapping plate portions is provided on a tip side in the longitudinal direction, and plate thicknesses of the first and second plate fittings are different from each other.

According to this aspect, since the male terminal inserting tube portion and the wire connecting portion and biased parts of the pair of overlapping plate portions disposed on both sides of the male terminal inserting tube portion can be provided by overlapping the first and second plate fittings on each other, the female terminal of the present disclosure can be easily manufactured. Further, since the female terminal fitting includes the first and second plate fittings, the plate thicknesses of the respective plate fittings can be made different from each other. Therefore, the plate thickness of the first and second plate fittings can be adjusted according to required properties and a degree of freedom in designing the female terminal can be enhanced.

A seventh aspect of the present disclosure is such that, in the female terminal according to the sixth aspect, the first plate fitting is in the form of a flat plate, the second plate fitting to be overlapped on the first plate fitting is configured such that both end parts in the longitudinal direction are in the form of flat plates and a central part in the longitudinal direction includes a convex portion constituting the peripheral wall of the male terminal inserting tube portion, having a convex cross-section convex in a direction separating from the first plate fitting and projecting along a plate width direction, and the first plate fitting has a larger plate thickness than the second plate fitting.

According to this aspect, the female terminal fitting is configured by overlapping the second plate fitting having a small plate thickness and including the both longitudinal sides in the form of flat plates and the longitudinal central part formed into the convex portion constituting the peripheral wall of the male terminal inserting tube portion on the first plate fitting in the form of a flat plate as a whole and having a large plate thickness. Therefore, when the male terminal is inserted into the male terminal inserting tube portion, the convex portion having the small plate thickness can be dominantly resiliently deformed and the insertion force of the male terminal can be advantageously reduced. Further, since a large plate thickness of the first plate fitting can be secured, the cross-sectional area of the wire connecting portion can be advantageously held and a current amount can also be secured.

An eighth aspect of the present disclosure is such that, in the female terminal according to the sixth aspect, the first plate fitting is in the form of a flat plate, the second plate fitting to be overlapped on the first plate fitting is configured such that both end parts in the longitudinal direction are in the form of flat plates and a central part in the longitudinal direction includes a convex portion constituting the peripheral wall of the male terminal inserting tube portion, having a convex cross-section convex in a direction separating from the first plate fitting and projecting along a plate width direction, and the first plate fitting has a smaller plate thickness than the second plate fitting.

According to this aspect, the female terminal fitting is configured by overlapping the second plate fitting having a large plate thickness and including the both longitudinal sides in the form of flat plates and the longitudinal central part formed into the convex portion constituting the peripheral wall of the male terminal inserting tube portion on the first plate fitting in the form of a flat plate as a whole and having a small plate thickness. Therefore, when the male terminal is inserted into the male terminal inserting tube portion, the close contact of the convex portion having the large plate thickness with the male terminal can be improved, resistance between the male and female terminals can be reduced and performances of the female terminal can be improved.

A ninth aspect of the present disclosure is such that, in the female terminal according to any one of the first to eighth aspects, the male terminal inserting tube portion has a rhombic cross-sectional shape.

According to this aspect, the male terminal inserting tube portion has the rhombic cross-sectional shape. In this way, the male terminal inserted into the male terminal inserting tube portion can be stably held by four sides of the rhombic shape. In this way, the positions of contact points can be fixed as compared to the case where the male terminal inserting tube portion has a circular cross-sectional shape. Therefore, the male terminal can be stably held at the positions of the contact points and manufacturing can be easily managed by observing a variation in the positions of the contact points.

A tenth aspect of the present disclosure is such that, in the female terminal according to any one of the first to ninth aspects, the inner surface of the male terminal inserting tube portion is formed into a tapered shape to gradually reduce a diameter toward a tip side in a press-fitting direction of the male terminal.

According to this aspect, since the inner surface of the male terminal inserting tube portion has the tapered shape to gradually reduce the diameter toward the tip side in the press-fitting direction of the male terminal, an insertion force of the male terminal in an initial stage of insertion into the male terminal inserting tube portion can be reduced. Particularly, if a tip part of the male terminal is tapered similarly to the inner surface of the male terminal inserting tube portion, no insertion force is generated until the male terminal is completely press-fit into the male terminal inserting tube portion and the male terminal can be withdrawn from the male terminal inserting tube portion only by being slightly pulled. Therefore, insertion and withdrawal forces of the male terminal into and from the male terminal inserting tube portion can be drastically reduced.

An eleventh aspect of the present disclosure is such that, in the female terminal according to the first aspect, the female terminal fitting further includes a pair of extending plate portions connected to the pair of first divided portions and extending further outward from projecting end parts of the pair of overlapping plate portions, and the pair of extending plate portions are overlapped on each other to configure a wire connecting portion, and second divided portions extending over the entire length in the axial direction are provided at another position in the circumferential direction of the male terminal inserting tube portion.

According to this aspect, the pair of extending plate portions further extend from the projecting end parts of the pair of overlapping plate portions and are overlapped on each other, whereby the wire connecting portion is configured. In addition, the second divided portions are provided and divided at the other position in the circumferential direction of the male terminal inserting tube portion separated from the overlapping plate portions and the wire connecting portion. Therefore, the insertion force of the male terminal into the male terminal inserting tube portion can be advantageously reduced while excellent conduction stability to the wire is ensured.

A twelfth aspect of the present disclosure is such that, in the female terminal according to any one of the first to eleventh aspects, a case is provided which is assembled with the female terminal fitting and has an accommodation space, the accommodation space being disposed above the overlapping plate portions, and the biasing means includes a spring member and is held on the female terminal fitting by being accommodated into the accommodation space of the case, and the spring member is held in a compressed state between the overlapping plate portions and a facing wall of the case facing the overlapping plate portions.

According to this aspect, the biasing means is configured by the spring member accommodated in the accommodation space of the case, and the case is assembled with the accommodation space thereof disposed above the pair of overlapping plate portions of the female terminal fitting overlapped on each other. Therefore, the biasing means can be stably held on the female terminal. Further, since the biasing means does not affect the structure of the connecting portion of the female terminal to be conductively connected to the male terminal, a degree of structural freedom of the connecting portion of the female terminal can be enhanced. Here, a coil spring, a leaf spring, a disk spring or the like can be utilized as the spring member.

A thirteenth aspect of the present disclosure is such that, in the female terminal according to any one of the first to twelfth aspects, the biasing means includes a coil spring.

According to this aspect, since the biasing means includes the coil spring, a large deflection amount of the biasing means for biasing the pair of overlapping plate portions in the overlapping direction can be secured. Therefore, a spring constant can be reduced while a compact configuration is realized by disposing the biasing means in the limited accommodation space of the case. Therefore, even if dimensional errors of components and the like occur, a change of the contact pressure between the male and female terminals can be suppressed to be small.

Hereinafter, embodiments of the present disclosure are described with reference to the drawings.

FIGS. 1 to 6 show a female terminal 10 as a first embodiment of the present disclosure. The female terminal 10 includes a female terminal fitting 16 having a connecting portion 14 (connector) to be conductively connected to a substantially hollow cylindrical pin-shaped male terminal 12. Further, the female terminal 10 includes a case 20 having an accommodation space 18 and to be assembled with the female terminal fitting 16. Note that, in the following description, an upper side means an upper side in FIGS. 1 and 4 to 6, a lower side means a lower side in FIGS. 1 and 4 to 6, a front side means a left side in FIGS. 2 to 4, a rear side means a right side in FIGS. 2 to 4, a longitudinal direction means a lateral direction in FIGS. 2 to 4 and a width direction means a vertical direction in FIGS. 2 and 3.

Figure 4:
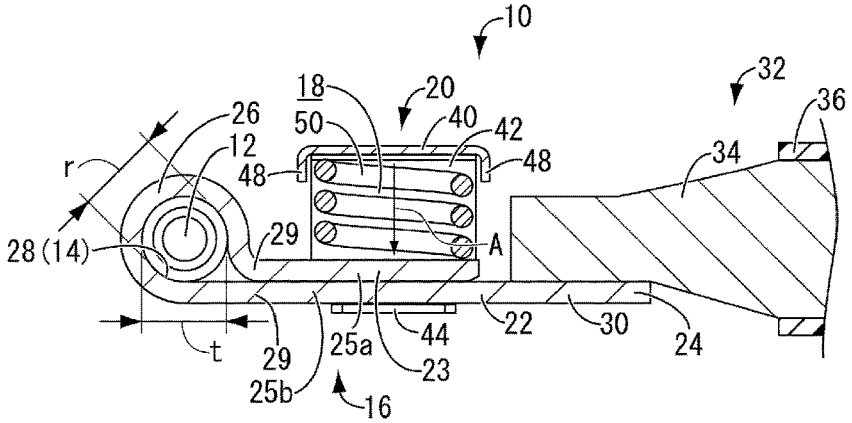
FIG. 4 is a section along IV-IV in FIG. 2.
Figure 5:
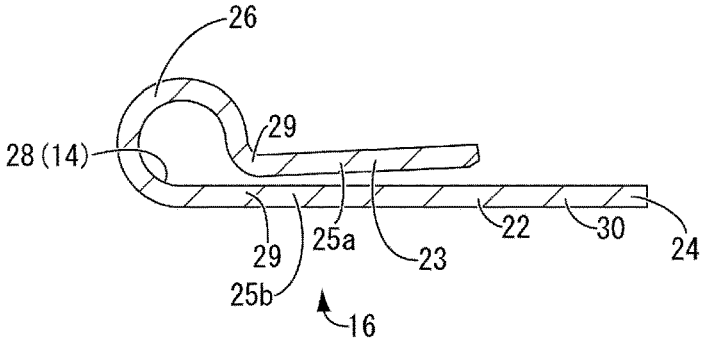
FIG. 5 is a section of a female terminal fitting shown in FIG. 4 showing a state before a pair of overlapping plate portions are biased by a biasing means.
Figure 6:
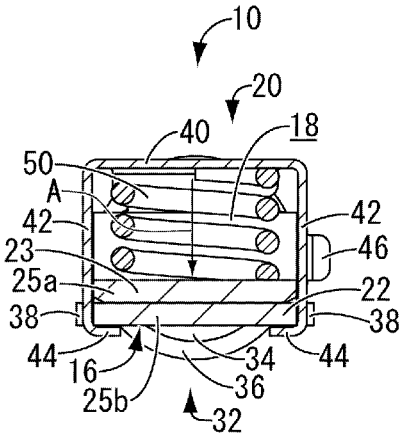
FIG. 6 is a section along VI-VI in FIG. 2.
Figure 7:
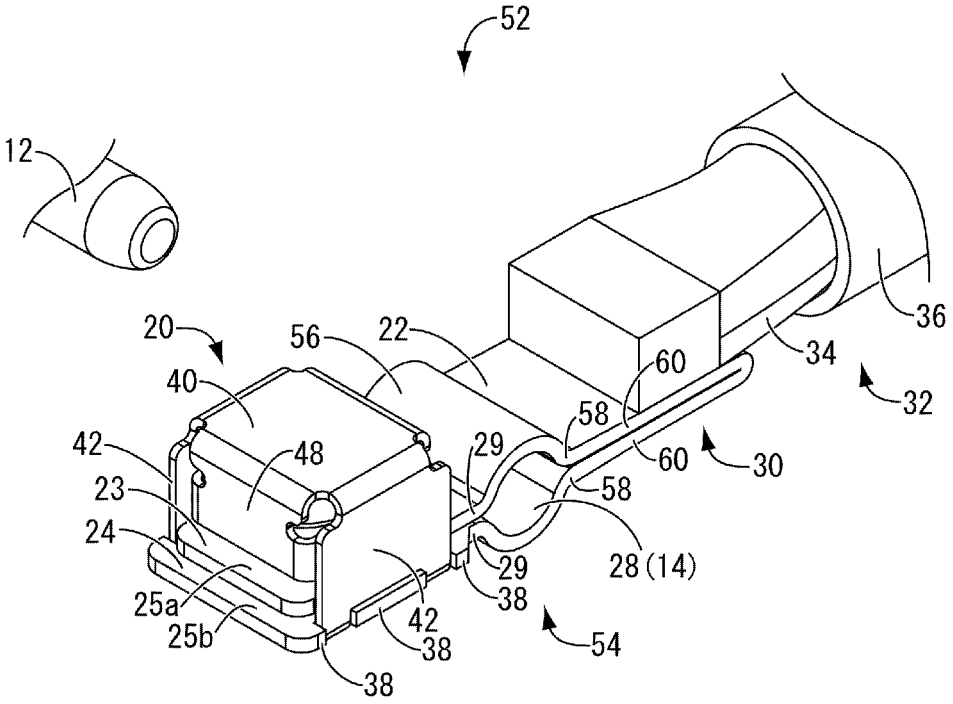
FIG. 7 is an overall perspective view showing a female terminal as a second embodiment of the present disclosure.
Figure 8:
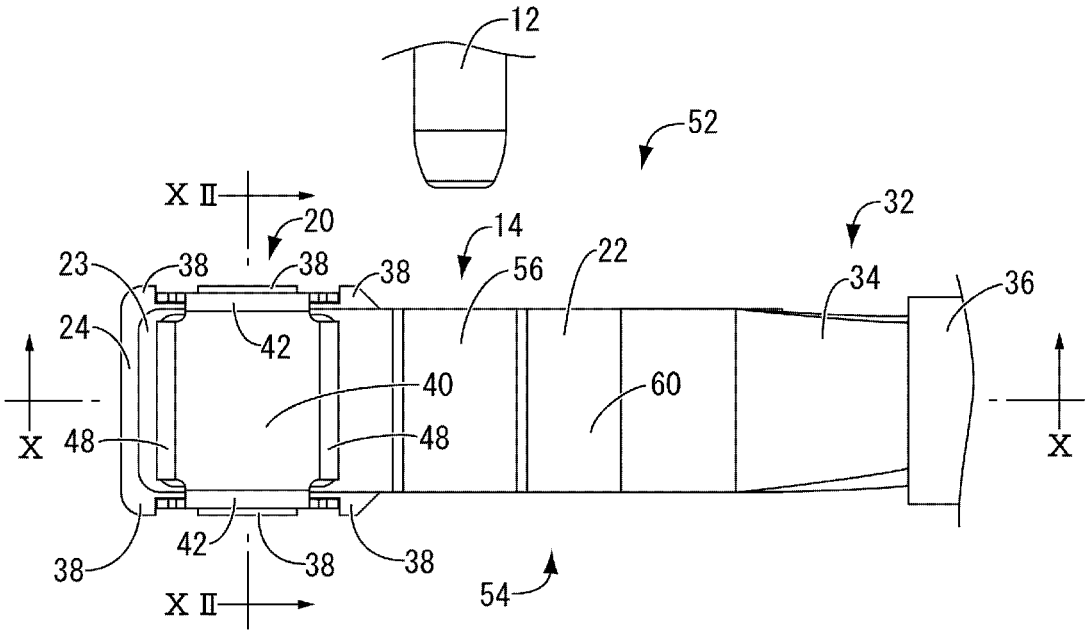
FIG. 8 is a plan view of the female terminal shown in FIG. 7.
Figure 9:
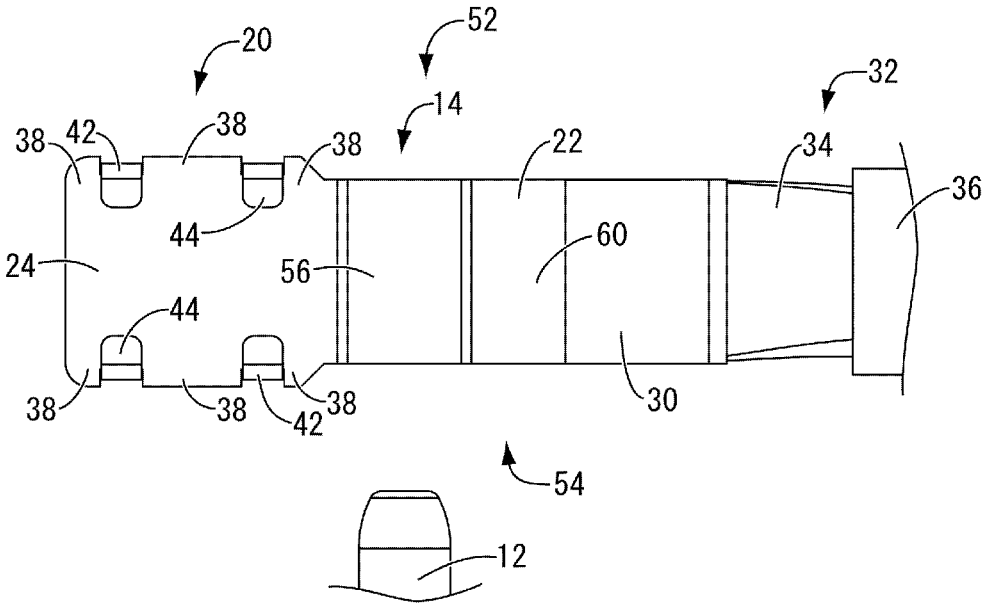
FIG. 9 is a bottom view of the female terminal shown in FIG. 7.
Figure 10:
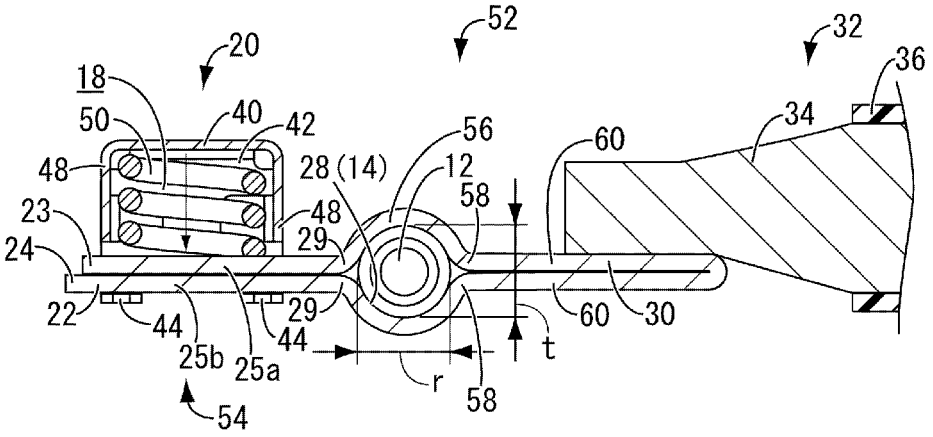
FIG. 10 is a section along X-X in FIG. 8.
Figure 11:
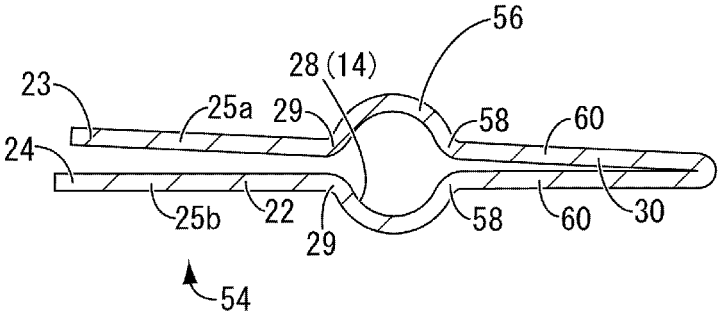
FIG. 11 is a section of a female terminal fitting shown in FIG. 10 showing a state before a pair of overlapping plate portions are biased by a biasing means.
Figure 12:
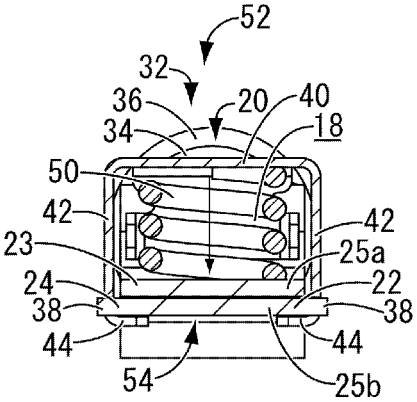
FIG. 12 is a section along XII-XII in FIG. 8.

As shown in FIGS. 1 and 4, the female terminal fitting 16 is configured using a strip-like flat metal plate 22, and one end part 23 in the longitudinal direction of the flat metal plate 22 constituting one 25*a* of a pair of overlapping plate portions 25*a*, 25*b* (overlapping plates) is folded toward another end part 24 (right side in FIGS. 4 and 5). By overlapping the one end part 23 on the other 25*b* of the pair of overlapping plate portions 25*a*, 25*b* provided on the side of the other end part 24 (central part in FIGS. 4 and 5), an intermediate part in the longitudinal direction (lateral direction in FIGS. 4 and 5) of the flat metal plate 22 is curved. In this way, a substantially hollow cylindrical male terminal inserting tube portion 26 (male terminal inserting tube) is formed which has a maximum inner diameter r smaller than a maximum outer diameter t of the male terminal 12 and is open on both sides in the width direction (direction perpendicular to the planes of FIGS. 4 and 5). Specifically, the male terminal inserting tube portion 26 is configured such that the male terminal 12 is press-fit thereinto. The connecting portion 14 is configured by an inner surface 28 of the male terminal inserting tube portion 26. As a result, the male terminal inserting tube portion 26 is divided over the entire length in an axial direction (direction perpendicular to the planes of FIGS. 4 and 5) of the male terminal inserting tube portion 26 at one circumferential position (oblique right-lower side in FIG. 4), whereby a pair of first dividing portions 29, 29 are formed. Further, the pair of overlapping plate portions 25*a*, 25*b* are provided which are connected to the pair of first divided portions 29, 29 and separated from each other and project outward (rightward in FIGS. 4 and 5). Furthermore, a wire connecting portion 30 is provided on the side (right side in FIGS. 4 and 5) of the other end part 24 in the longitudinal direction of the flat metal plate 22. The female terminal fitting 16 having such a structure is conductive and formed using any one of various metal materials, which can be press-worked and stamped, such as brass, copper, copper alloy, aluminum and aluminum alloy.

In the wire connecting portion 30, a core 34 of a wire 32 is conductively connected to the female terminal fitting 16. More particularly, the wire 32 is structured such that the core 34 serving as a conductor and formed by bundling a plurality of metal wires made of copper, aluminum or another metal is covered by an insulation coating 36 having electrical insulation and made of ethylene-based resin, styrene-based resin or the like. The core 34 exposed by stripping the insulation coating 36 on an end of the wire 32 is fixed to the wire connecting portion 30 of the female terminal fitting 16 using a known technique such as resistance welding, whereby the core 34 of the wire 32 is conductively connected to the female terminal fitting 16.

Figure 2:
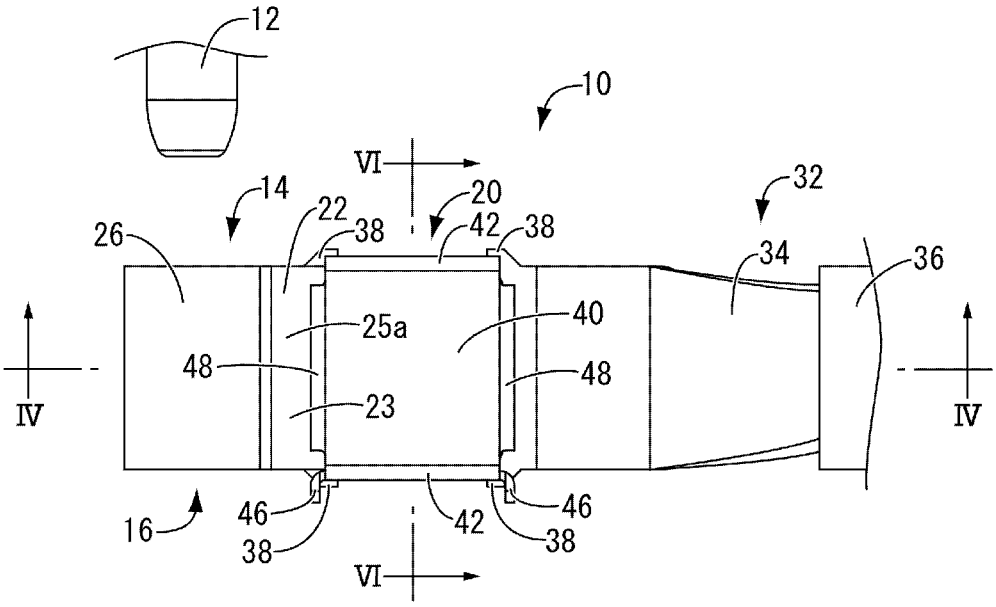
FIG. 2 is a plan view of the female terminal shown in FIG. 1.
Figure 3:
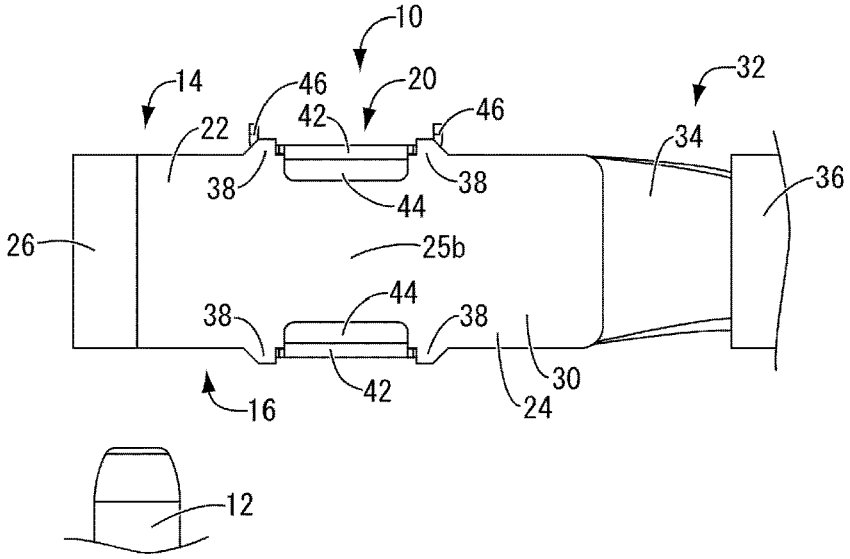
FIG. 3 is a bottom view of the female terminal shown in FIG. 1.

As shown in FIGS. 1 to 3, a pair of engaging projections 38, 38 substantially in the form of rectangular flat plates projecting outward in the width direction at two positions separated in the longitudinal direction are provided on each of both side edge parts in the width direction (vertical direction in FIGS. 2 and 3) of the other 25*b* of the pair of overlapping plate portions 25*a*, 25*b* of the flat metal plate 22 constituting the female terminal fitting 16.

The case 20 is assembled with the female terminal fitting 16 thus configured (see, for example, FIG. 4). The case 20 is formed using any one of various metal materials, which can be press-worked and stamped, such as brass, copper, copper alloy, aluminum, aluminum alloy and stainless steel. The case 20 is so assembled with the female terminal fitting 16 that the accommodation space 18 is disposed above the one 25*a* of the pair of overlapping plate portions 25*a*, 25*b* of the female terminal fitting 16. More particularly, in an assembled state, the case 20 includes a facing wall portion 40 substantially in the form of a rectangular flat plate facing the one 25*a* of the pair of overlapping plate portions 25*a*, 25*b* via the accommodation space 18. Further, the case 20 includes a pair of wall portions 42, 42 substantially in the form of rectangular flat plates extending downward from both side edge parts in the width direction (vertical direction in FIG. 2) of the facing wall portion 40, and the accommodation space 18 is configured by the facing wall portion 40 and the pair of wall portions 42, 42. Furthermore, the case 20 includes a pair of crimping portions 44 substantially in the form of flat plates projecting downward on extending end parts of the pair of wall portions 42, 42. Further, engaging projections 46 substantially in the form of flat plates projecting outward in the width direction and bent outward in a plate thickness direction (vertical direction in FIG. 2) are provided on both side edge parts in the width direction (lateral direction in FIG. 2) located on the other 25*b* (see FIG. 5) of the pair of overlapping plate portions 25*a*, 25*b* on the wall portion 42 on one side (lower side in FIG. 2). In addition, coil spring holding walls 48 projecting downward substantially over the entire length in the width direction (vertical direction in FIG. 2) are provided on both side edge parts in the longitudinal direction (lateral direction in FIG. 2) of the facing wall 40 (see FIGS. 1 and 4).

The case 20 thus configured is held on the one 25*a* of the pair of overlapping plate portions 25*a*, 25*b* with a coil spring 50 made of metal and serving as a spring member constituting a biasing means accommodated and arranged in the accommodation space 18 (see, for example, FIG. 4). More particularly, the case 20 is placed above the one 25*a* of the pair of overlapping plate portions 25*a*, 25*b* of the female terminal fitting 16 with the coil spring 50 arranged in the accommodation space 18. The crimping portions 44 of the case 20 are bent inwardly in the width direction (vertical direction in FIG. 3) and crimped after being inserted between the pairs of engaging projections 38, 38 provided on the side edge parts of the other 25*b* of the pair of overlapping plate portions 25*a*, 25*b*. In this way, the case 20 is fixed with extending end parts of the pair of wall portions 42, 42 placed on the pairs of the engaging projections 38, 38, and the coil spring 50 accommodated in the case 20 is indirectly held on the female terminal fitting 16. Further, the coil spring 50 is held in a compressed state between the one 25*a* of the pair of overlapping plate portions 25*a*, 25*b* and the facing wall 40 of the case 20. The pair of overlapping plate portions 25*a*, 25*b* are biased in a mutually approaching direction (direction of an arrow A in FIGS. 4 and 6) by the coil spring 50 held in the compressed state in this way. Specifically, the coil spring 50 serving as the biasing means for biasing the pair of overlapping plate portions 25*a*, 25*b* in the approaching direction is disposed and held between the wire connecting portion 30 and the male terminal inserting tube portion 26.

Since the spring member constituting the biasing means is configured using the coil spring 50 as just described in this embodiment, a large deflection amount can be secured. In this way, the coil spring 50 having a small spring constant can be compactly disposed in the accommodation space 18, which is a limited accommodation space of the case 20. Therefore, a change of a contact pressure between the female terminal 10 and the male terminal 12 can be suppressed to be small even if the plate thickness of the flat metal plate 22, the maximum inner diameter r and the like vary. Further, since the coil spring 50 serving as the biasing means is disposed and held between the wire connecting portion 30 and the male terminal inserting tube portion 26, a separation distance of the male terminal inserting tube portion 26 from the wire connecting portion 30 is secured. In this way, the male terminal inserting tube portion 26 can be advantageously protected from thermal effect when the core 34 exposed on the end of the wire 32 is connected and fixed to the wire connecting portion 30 by welding or the like, and influences and the like on plating properties of the male terminal inserting tube portion 26 by thermal effect can be reduced or avoided.

The male terminal 12 is conductively connected to the thus configured female terminal 10. More particularly, the male terminal 12 is press-fit into the male terminal inserting tube portion 26 of the female terminal 10. The one 25*a* of the pair of overlapping plate portions 25*a*, 25*b* is slidingly displaced toward the male terminal inserting tube portion 26 with respect to the other 25*b* against a biasing force biasing the pair of overlapping plate portions 25*a*, 25*b* in the mutually approaching direction by the coil spring 50. In this way, the male terminal inserting tube portion 26 is resiliently deformed in a diameter expanding direction to allow the male terminal 12 to be press-fit into the male terminal inserting tube portion 26. After insertion, the inner surface 28 of the male terminal inserting tube portion 26 constituting the connecting portion 14 is pressed into contact with and held on the male terminal 12 with a high contact pressure in a connected state by a resilient return force of the male terminal inserting tube portion 26. Specifically, the male terminal inserting tube portion 26 resiliently deformable in the diameter expanding direction is held in a reduced diameter state by the coil spring 50 constituting the biasing means. Note that the contact pressure between the female terminal 10 and the male terminal 12 can be changed by the strength of the coil spring 50.

According to the female terminal 10 of this embodiment thus configured, since the coil spring 50 serving as the spring member constituting the biasing means is held on the female terminal fitting 16, it is not necessary to mount a separate spring member or the like as before after the male terminal 12 is conductively connected to the female terminal 10. Therefore, a working process can be simplified and a high contact pressure between the male terminal 12 and the female terminal 10 can be realized by excellent workability. Further, when the male terminal 12 is press-fit into the male terminal inserting tube portion 26 of the female terminal 10, the one 25*a* of the pair of overlapping plate portions 25*a*, 25*b* is slidingly displaced toward the male terminal inserting tube portion 26 with respect to the other 25*b* against the biasing force of the coil spring 50 serving as the biasing means. In this way, the male terminal inserting tube portion 26 is resiliently deformed in the diameter expanding direction to allow the male terminal 12 to be press-fit into the male terminal inserting tube portion 26. As a result, the connecting portion 14 configured by the inner surface 28 of the male terminal inserting tube portion 26 is pressed into contact with the male terminal 12 by a resilient return force of the male terminal inserting tube portion 26, wherefore a large contact pressure is ensured between the female terminal 10 and the male terminal 12. Further, a direction of sliding displacement (leftward direction in FIG. 4) and a biasing direction (direction of the arrow A in FIGS. 4 and 6) by the coil spring 50 are made different. Therefore, it is possible to stably maintain a press-contact state while advantageously reducing an insertion force in inserting the male terminal 12 into the inner surface 28 of the male terminal inserting tube portion 26 constituting the connecting portion 14 of the female terminal 10. Further, even if a certain external force is applied to the male terminal 12, the external force is transmitted in a radially outward direction of the male terminal inserting tube portion 26 of the female terminal 10 and transmitted in such a direction that the pair of overlapping plate portions 25*a*, 25*b* are slidingly displaced from each other. As a result, the transmitting direction of the external force and the biasing direction (direction of the arrow A in FIGS. 4 and 6) by the coil spring 50 are made different. Thus, it is possible to advantageously reduce or prevent a variation of the contact pressure between the female terminal 10 and the male terminal 12 due to the external force, wherefore an improvement of conduction stability between the female terminal 10 and the male terminal 12 can also be ensured.

In addition, since the case 20 is held on the pair of overlapping plate portions 25*a*, 25*b* with the coil spring 50 serving as the spring member constituting the biasing means accommodated and arranged in the accommodation space 18, the biasing means can be stably held with respect to the female terminal 10. Further, since the biasing means does not affect the structure of the connecting portion 14 of the female terminal 10 to be conductively connected to the male terminal 12, a degree of freedom in designing the structure of the connecting portion 14 of the female terminal 10 can be enhanced.

Further, in this embodiment, the pair of first divided portions 29, 29 formed by dividing the male terminal inserting tube portion 26 over the entire length in the axial direction of the male terminal inserting tube portion 26 at one circumferential position are provided by a simple structure of folding the one end part 23 of the strip-like flat metal plate 22 toward the other end part 24. Furthermore, the pair of overlapping plate portions 25*a*, 25*b* are provided which are connected to the pair of first divided portions 29, 29 and separated from each other and project outward. Therefore, the female terminal fitting 16 provided with the male terminal inserting tube portion 26 can be easily manufactured with a good yield.

Next, a female terminal 52 as a second embodiment of the present disclosure is described in detail using FIGS. 7 to 12. Members and parts structured as in the above embodiment are denoted by the same reference signs as in the above embodiment in figures and not described in detail. This embodiment differs from the first embodiment in that a female terminal fitting 54 is provided with a pair of second divided portions 58, 58 extending over the entire length in an axial direction of a male terminal inserting tube portion 56 at another circumferential position of the male terminal inserting tube portion 56. More particularly, a pair of first divided portions 29, 29 are formed at one circumferential position (left side in FIG. 10) of the male terminal inserting tube portion 56 in the female terminal fitting 54, and a pair of overlapping plate portions 25*a*, 25*b* are provided which are connected to the pair of first divided portions 29, 29 and project outward (leftward in FIG. 10). Further, the pair of second divided portions 58, 58 are formed at another circumferential position of the male terminal inserting tube portion 56 facing the pair of first divided portions 29, 29 in a radial direction of the male terminal inserting tube portion 56. A pair of extending plate portions 60, 60 are provided which are connected to the pair of second divided portions 58, 58 and project outward (rightward in FIG. 10). The pair of overlapping plate portions 25*a*, 25*b* are biased in a mutually approaching direction (direction of an arrow in FIGS. 10 and 12), and the pair of extending plate portions 60, 60 are overlapped on each other to configure a wire connecting portion 30. In this embodiment, the pair of extending plate portions 60, 60 are fixed to and integrated with each other using a known arbitrary means such as resistance welding. As a result, the male terminal inserting tube portion 56 is disposed between the wire connecting portion 30 and the pair of overlapping plate portions 25*a*, 25*b* in a longitudinal direction (lateral direction in FIG. 10) of the female terminal fitting 54. Note that, in this embodiment, the female terminal fitting 54 is configured using a strip-like flat metal plate 22, the flat metal plate 22 is folded into two and one end part 23 in the longitudinal direction of the flat metal plate 22 is folded toward another end part 24 (left side in FIG. 10). With the one end part 23 folded over the other end part 24 (left side in FIG. 10), intermediate parts in the longitudinal direction (lateral direction in FIG. 10) of overlapping surfaces are curved in directions separating from each other, whereby the substantially hollow cylindrical male terminal inserting tube portion 26 is configured. Further, the pair of extending plate portions 60, 60 can configure the wire connecting portion 30 while being overlapped on each other. The efficiency of workability can be achieved by simultaneously welding the extending plate portions 60, 60 to each other in welding the core 34 of the wire 32 to the wire connecting portion 30.

Also in the female terminal 52 of the embodiment thus configured, a coil spring 50 serving as a spring member constituting a biasing means is held on the female terminal fitting 54 as in the first embodiment. Thus, it is not necessary to mount a separate spring member or the like as before after a male terminal 12 is conductively connected to the female terminal 52. Therefore, a working process can be simplified and a high contact pressure between the female terminal 52 and the male terminal 12 can be realized by excellent workability. Further, when the male terminal 12 is press-fit into the male terminal inserting tube portion 56 of the female terminal 52, the one 25*a* of the pair of overlapping plate portions 25*a*, 25*b* is slidingly displaced toward the male terminal inserting tube portion 56 with respect to the other 25*b* against a biasing force of the coil spring 50 serving as the biasing means. In this way, the male terminal inserting tube portion 56 is resiliently deformed in a diameter expanding direction to allow the male terminal 12 to be press-fit into the male terminal inserting tube portion 56. Therefore, the connecting portion 14 configured by an inner surface 28 of the male terminal inserting tube portion 56 is pressed into contact with the male terminal 12 by a resilient return force of the male terminal inserting tube portion 56, and a large contact pressure between the female terminal 52 and the male terminal 12 is secured.

According to this embodiment, the pair of extending plate portions 60, 60 extending from the pair of second divided portions 58, 58 provided in the male terminal inserting tube portion 56 are overlapped on each other, whereby the wire connecting portion 30 is provided. In this way, the pair of extending plate portions 60, 60 extending from the pair of second divided portions 58, 58 can both serve as current paths. Thus, a cross-sectional area of the wire connecting portion 30 in which the pair of extending plate portions 60, 60 are overlapped on each other can be advantageously secured and more current can flow. Therefore, the cross-sectional area of the wire connecting portion 30 can be secured while a plate thickness of the male terminal inserting tube portion 56 is reduced. Hence, a cross-sectional area of the current path can be secured while it is enabled to reduce an insertion force of the male terminal 12 into the male terminal inserting tube portion 56 by facilitating resilient deformation of the male terminal inserting tube portion 56. Further, since the male terminal inserting tube portion 56 is configured and arranged between the wire connecting portion 30 and the pair of overlapping plate portions 25*a*, 25*b*, the coil spring 50 serving as the biasing means needs not be disposed between the male terminal inserting tube portion 56 to be pressed into contact with the male terminal 12 and the wire connecting portion 30 as in the first embodiment. In this way, the current path between the connecting portion 14 of the female terminal 52 and the wire connecting portion 30 can be shortened and resistance can be reduced.

Figure 13:
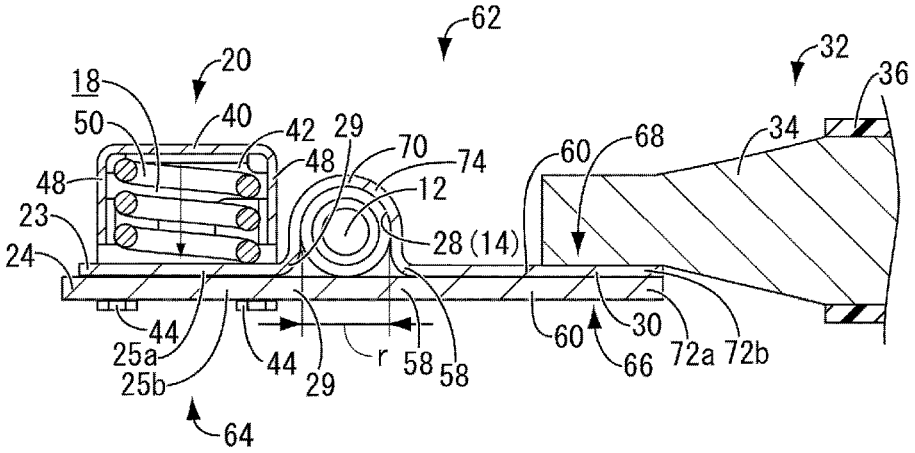
FIG. 13 is a section, corresponding to FIG. 10, showing a female terminal as a third embodiment of the present disclosure.

Next, a female terminal 62 as a third embodiment of the present disclosure is described in detail using FIG. 13. Members and parts structured as in the above embodiments are denoted by the same reference signs as in the above embodiments in figures and not described in detail. This embodiment differs from the second embodiment in that a female terminal fitting 64 includes a first plate fitting 66 and a second plate fitting 68 and plate thicknesses of the first and second plate fittings 66, 68 are different from each other. More particularly, the first plate fitting 66 is formed by integrally configuring one 25*b* of a pair of overlapping plate portions 25*a*, 25*b* connected to one (lower one in FIG. 13) of a pair of first divided portions 29, 29, a peripheral wall of a male terminal inserting tube portion 70 extending from the one of the pair of first divided portions 29, 29 toward one (lower one in FIG. 13) of a pair of second divided portions 58, 58, and one (lower one in FIG. 13) of a pair of extending plate portions 60, 60 extending from the one of the pair of second divided portions 58, 58. The second plate fitting 68 is formed by integrally configuring the other 25*a* of the pair of overlapping plate portions 25*a*, 25*b* connected to the other (upper one in FIG. 13) of the pair of first divided portions 29, 29, the peripheral wall of the male terminal inserting tube portion 70 extending from the other of the pair of first divided portions 29, 29 toward the other (upper one in FIG. 13) of the pair of second divided portions 58, 58, and the other (upper one in FIG. 13) of the pair of extending plate portions 60, 60 extending from the other of the pair of second divided portions 58, 58. By overlapping the first and second plate fittings 66, 68 on each other, the male terminal inserting tube portion 70 is configured in central parts in the longitudinal direction (lateral direction in FIG. 13) of the first and second plate fittings 66, 68. A wire connecting portion 30 in which the first and second plate fittings 66, 68 are fixed is configured on a base end side (right side in FIG. 13) in the longitudinal direction, and a coil spring 50 constituting a biasing means for overlapping the pair of overlapping plate portions 25*a*, 25*b* on each other and biasing the pair of overlapping plate portions 25*a*, 25*b* is disposed on a tip side (left side in FIG. 13) in the longitudinal direction. Note that, in this embodiment, the first and second plate fittings 66, 68 are respectively configured using flat metal plates 72*a*, 72*b*, and the flat metal plate 72*a* has a larger plate thickness than the flat metal plate 72*b*. The first plate fitting 66 is substantially in the form of a flat plate. The second plate fitting 68 to be overlapped on the first plate fitting 66 is configured such that both end parts in the longitudinal direction (lateral direction in FIG. 13) are in the form of flat plates and a longitudinal central part includes a convex portion 74 constituting the peripheral wall of the male terminal inserting tube portion 70, having a convex cross-sectional shape convex in a direction separating from the first plate fitting 66 and projecting along a plate width direction.

Also in the female terminal 62 of this embodiment thus configured, a coil spring 50 serving as a spring member constituting a biasing means is held on the female terminal fitting 64 as in the first embodiment. Thus, it is not necessary to mount a separate spring member or the like as before after a male terminal 12 is conductively connected to the female terminal 62. Therefore, a working process can be simplified and a high contact pressure between the female terminal 62 and the male terminal 12 can be realized by excellent workability. Further, when the male terminal 12 is press-fit into the male terminal inserting tube portion 70 of the female terminal 62, the one 25*a* of the pair of overlapping plate portions 25*a*, 25*b* is slidingly displaced toward the male terminal inserting tube portion 70 with respect to the other 25*b* against a biasing force of the coil spring 50 serving as the biasing means. In this way, the male terminal inserting tube portion 70 is resiliently deformed in a diameter expanding direction to allow the male terminal 12 to be press-fit into the male terminal inserting tube portion 70. As a result, a connecting portion 14 configured by an inner surface 28 of the male terminal inserting tube portion 70 is pressed into contact with the male terminal 12 by a resilient return force of the male terminal inserting tube portion 70, and a large contact pressure between the female terminal 62 and the male terminal 12 is secured.

According to this embodiment, the male terminal inserting tube portion 70 and the wire connecting portion 30 and the pair of overlapping plate portions 25*a*, 25*b* provided on both sides of the male terminal inserting tube portion 70, the coil spring 50 serving as the biasing means being disposed on the pair of overlapping plate portions 25*a*, 25*b*, can be provided by overlapping the first and second plate fittings 66, 68 on each other. In this way, the female terminal 62 of the present disclosure can be easily manufactured. Further, since the plate thicknesses of the first and second plate fittings 66, 68 can be made different from each other, the plate thicknesses of the first and second plate fittings 66, 68 can be adjusted according to required properties and a degree of freedom in designing the female terminal 62 can be enhanced. Furthermore, the female terminal fitting 64 is configured by overlapping the second plate fitting 68 having a small plate thickness and including the both longitudinal sides in the form of flat plates and the longitudinal central part formed into the convex portion 74 constituting the peripheral wall of the male terminal inserting tube portion 70 on the first plate fitting 66 in the form of a flat plate and having a large plate thickness. Therefore, when the male terminal 12 is inserted into the male terminal inserting tube portion 70, the convex portion 74 having the small plate thickness can be dominantly resiliently deformed. Thus, an insertion force of the male terminal 12 can be advantageously reduced. In addition, since a large plate thickness of the first plate fitting 66 can be secured, a cross-sectional area of the wire connecting portion 30 can be advantageously maintained and a current amount can also be secured.

Figure 14:
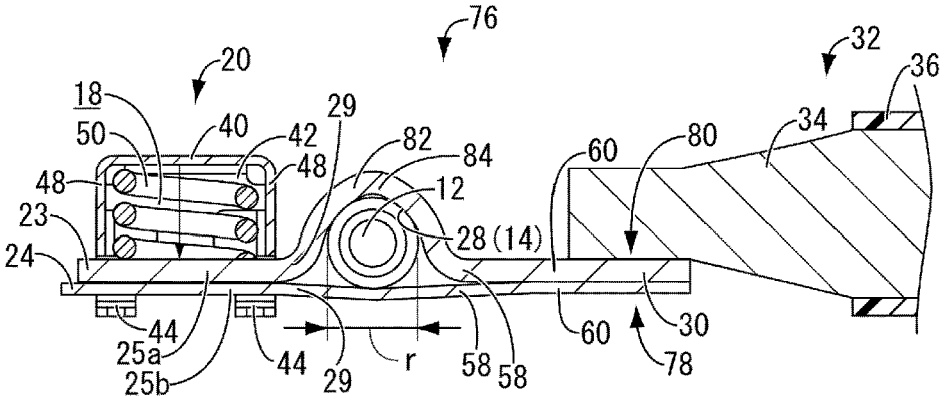
FIG. 14 is a section, corresponding to FIG. 13, showing a female terminal as a fourth embodiment of the present disclosure.

In addition, a first plate fitting 78 may have a smaller plate thickness than a second plate fitting 80 like a female terminal 76 as a fourth embodiment of the present disclosure shown in FIG. 14. Specifically, the first plate fitting 78 is in the form of a flat plate. The second plate fitting 80 to be overlapped on the first plate fitting 78 is configured such that both end parts in the longitudinal direction (lateral direction in FIG. 14) are in the form of flat plates and a longitudinal central part includes a convex portion 84 constituting a peripheral wall of a male terminal inserting tube portion 82, having a convex cross-section convex in a direction separating from the first plate fitting 78 and projecting along a plate width direction. If the second plate fitting 80 having a large plate thickness is formed with the convex portion 84 constituting the peripheral wall of the male terminal inserting tube portion 82 as in this embodiment, the plate thickness of the convex portion 84 to be held in close contact with the male terminal 12 when the male terminal 12 is inserted into the male terminal inserting tube portion 82 is large. Therefore, it is possible to reduce resistance between the female terminal 76 and the male terminal 12.

Figure 15:
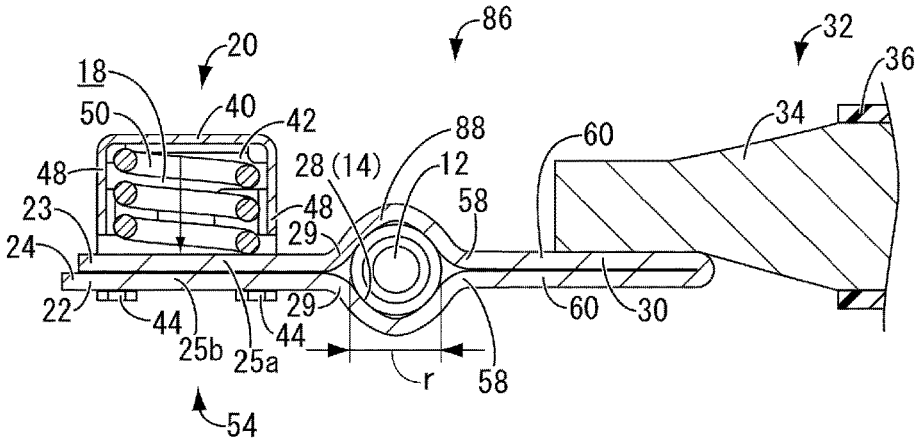
FIG. 15 is a section, corresponding to FIG. 10, showing a female terminal as a fifth embodiment of the present disclosure.

Further, a male terminal inserting tube portion 88 may have a substantially rhombic cross-sectional shape with rounded corners like a female terminal 86 as a fifth embodiment of the present disclosure shown in FIG. 15. In this way, a male terminal 12 inserted into the male terminal inserting tube portion 88 can be stably held by central parts of four sides of the rhombic shape constituting an inner surface 28. Specifically, as compared to the case where the male terminal inserting tube portion 56 has a circular cross-sectional shape as in the second embodiment, the positions of contact points for holding the inserted male terminal 12 can be fixed. Therefore, the male terminal 12 can be stably held at the positions of the contact points and manufacturing can be easily managed by observing a variation in the positions of the contact points. Note that known embossed parts may project on the inner surface 28 of the male terminal inserting tube portion 88 to further clarify the positions of the contact points. In the case of this embodiment, embossed parts may be respectively provided on the central parts of the four sides of the rhombic shape.

Figure 16:
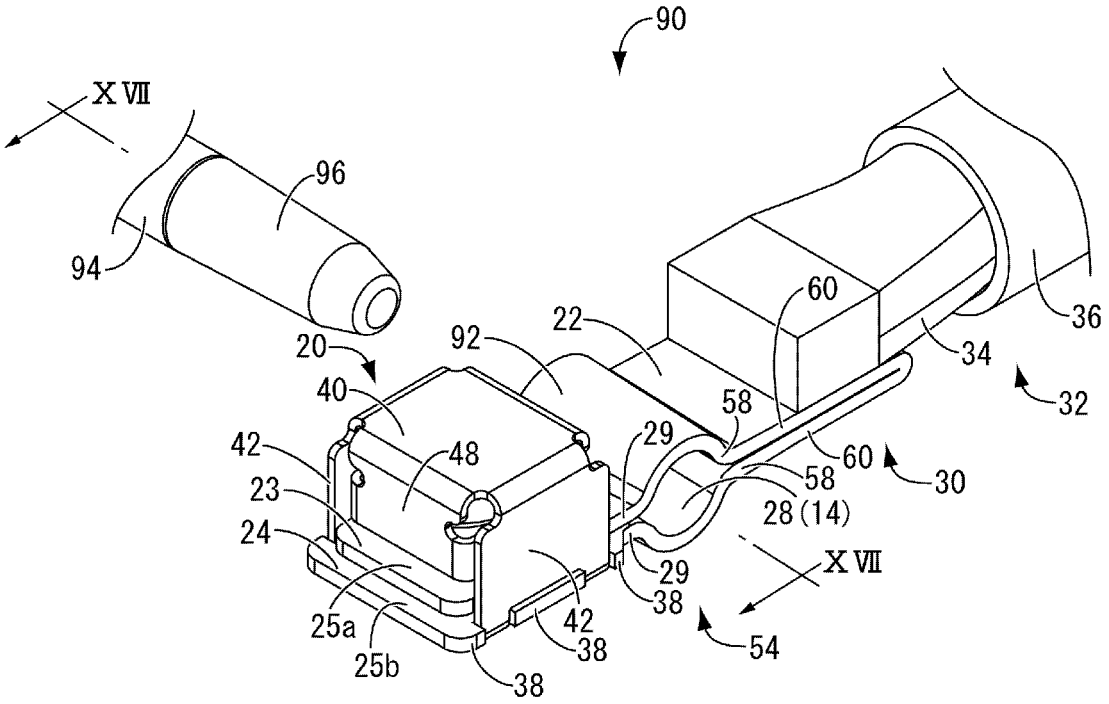
FIG. 16 is an overall perspective view showing a female terminal as a sixth embodiment of the present disclosure.
Figure 17:
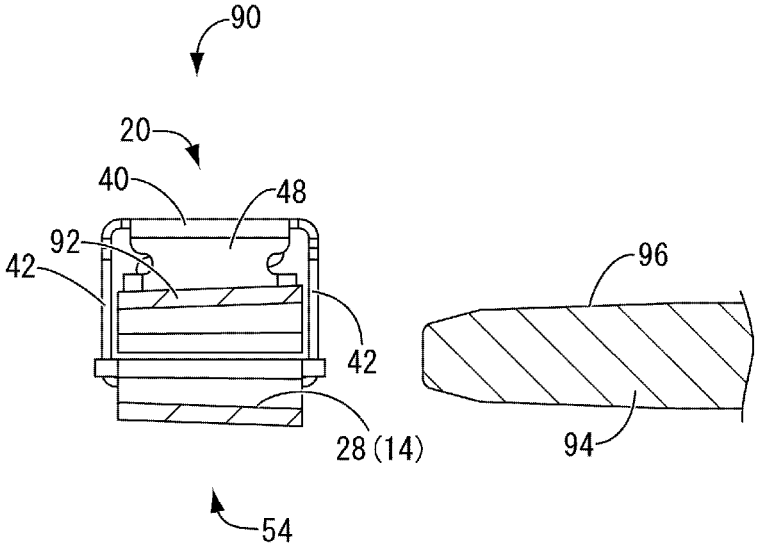
FIG. 17 is a section along XVII-XVII in FIG. 16.

Alternatively, an inner surface 28 of a male terminal inserting tube portion 92 may be tapered to gradually reduce a diameter toward a tip side (left side in FIG. 17) in a press-fitting direction (leftward direction in FIG. 17) of a male terminal 94 like a female terminal 90 as a sixth embodiment of the present disclosure shown in FIGS. 16 and 17. In this way, the male terminal 94 does not contact the inner surface 28 in an initial stage of insertion into the male terminal inserting tube portion 92, wherefore an insertion force in the initial stage of insertion can be reduced. Particularly, if a tip surface 96 on a tip part of the male terminal 94 is tapered similarly to the inner surface 28 of the male terminal inserting tube portion 92 as in this embodiment, no insertion force is generated until the male terminal 94 is completely press-fit into the male terminal inserting tube portion 92. Therefore, the male terminal 94 can be withdrawn from the male terminal inserting tube portion 92 only by being slightly pulled, and insertion and withdrawal forces of the male terminal 94 into and from the male terminal inserting tube portion 92 can be drastically reduced.

Figure 18:
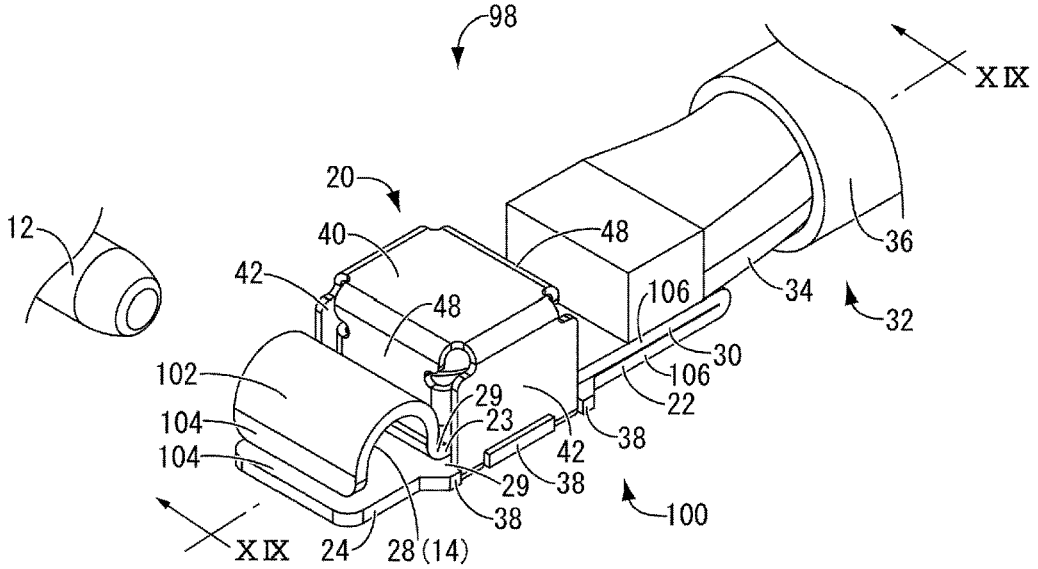
FIG. 18 is an overall perspective view showing a female terminal as a seventh embodiment of the present disclosure.
Figure 19:
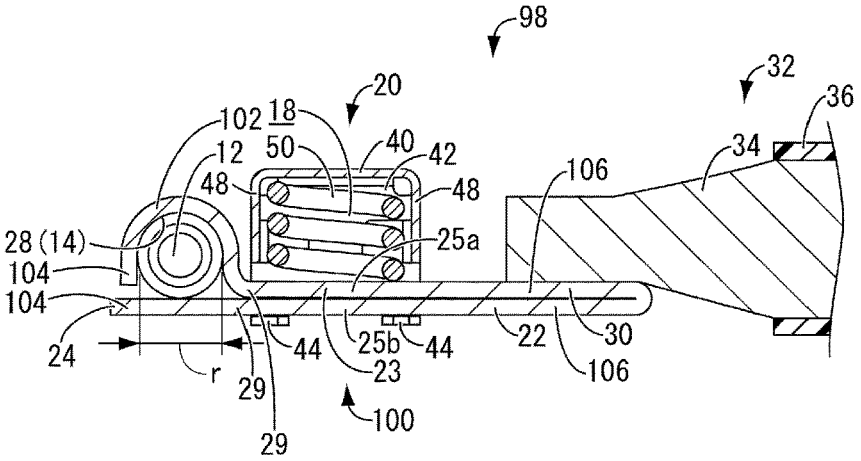
FIG. 19 is a section along XIX-XIX in FIG. 18.
Figure 20:
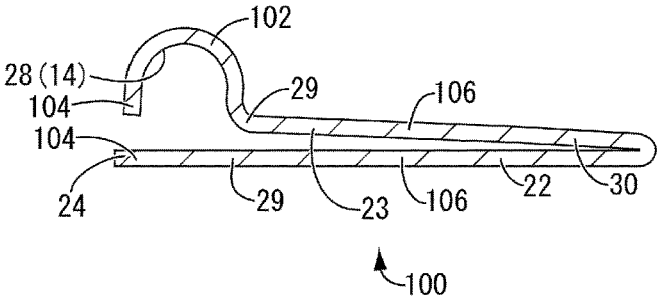
FIG. 20 is a section of a female terminal fitting shown in FIG. 19 showing a state before a pair of overlapping plate portions are biased by a biasing means.

Next, a female terminal 98 as a seventh embodiment of the present disclosure is described in detail using FIGS. 18 to 20. Members and parts structured as in the above embodiments are denoted by the same reference signs as in the above embodiments in figures and not described in detail. This embodiment differs from the second embodiment in that a female terminal fitting 100 is provided with a pair of second divided portions 104, 104 extending over the entire length in an axial direction of a male terminal inserting tube portion 102 at another circumferential position of the male terminal inserting tube portion 102. More particularly, the female terminal fitting 100 is provided with a pair of overlapping plate portions 25*a*, 25*b* connected to a pair of first divided portions 29, 29 and projecting outward (rightward in FIG. 19), and a coil spring 50 accommodated in a case 20 is disposed and held on the pair of overlapping plate portions 25*a*, 25*b*. The female terminal fitting 100 further includes a pair of extending plate portions 106, 106 extending further outward (rightward in FIG. 19) from projecting end parts of the pair of overlapping plate portions 25*a*, 25*b*. The pair of extending plate portions 106, 106 are overlapped on each other, and fixed to and integrated with each other, for example, when a core 34 of a wire 32 is welded to a wire connecting portion 30. Further, the pair of second divided portions 104, 104 extending over the entire length in the axial direction of the male terminal inserting tube portion 102 are provided at the other circumferential position of the male terminal inserting tube portion 102, and are both free ends.

Also in the female terminal 98 of the embodiment thus configured, the coil spring 50 serving as a spring member constituting a biasing means is held on the female terminal fitting 100 as in the first embodiment. Thus, it is not necessary to mount a separate spring member or the like as before after a male terminal 12 is conductively connected to the female terminal 98. Therefore, a working process can be simplified and a high contact pressure between the female terminal 98 and the male terminal 12 can be realized by excellent workability.

Further, according to this embodiment, the pair of second divided portions 104, 104 extending over the entire length in the axial direction of the male terminal inserting tube portion 102 are provided at the other circumferential position of the male terminal inserting tube portion 102, and are both free ends. In this way, when the male terminal 12 is press-fit into the male terminal inserting tube portion 102, the pair of second divided portions 104, 104 are displaced in separating directions, whereby the male terminal inserting tube portion 102 is resiliently deformed in a diameter expanding direction to allow the male terminal 12 to be press-fit into the male terminal inserting tube portion 102. Therefore, an insertion force of the male terminal 12 into the male terminal inserting tube portion 102 can be advantageously reduced.

Although a plurality of the embodiments of the present disclosure have been described in detail above, the present disclosure is not limited by the specific description of these embodiments. For example, although the coil spring 50 is illustrated as the biasing means in the above embodiments, the biasing means is not limited to this and, for example, any of known members for applying a biasing force such as spring members including leaf springs and disc springs and elastic bodies including rubber elastic bodies can be employed as such. Further, although the coil spring 50 is indirectly held on the female terminal fitting 16, 54, 64, 100 via the case 20 in the above embodiments, the coil spring 50 may be directly held.

Further, although the wire 32 fixed to the wire connecting portion 30 extends in the direction orthogonal to the axial direction of the male terminal inserting tube portion 26, 56, 70, 82, 88, 92, 102 in the above embodiments, the wire 32 may be so fixed to the wire connecting portion 30 as to extend in the axial direction of the male terminal inserting tube portion 26, 56, 70, 82, 88, 92, 102. In addition, although the case 20 is made of metal in the above embodiments, any member having a sufficient rigidity may be used and a synthetic resin or the like can be employed.

Further, although the male terminal inserting tube portion 26, 56, 70, 82, 92, 102 having a substantially hollow cylindrical shape or the male terminal inserting tube portion 88 having a substantially rhombic shape is illustrated in the above embodiments, there is no limitation to this. A cross-sectional shape of the male terminal inserting tube portion 26, 56, 70, 82, 88, 92, 102 can be a rectangular shape, an elliptical shape, a polygonal shape or the like in conformity with a cross-sectional shape of a male terminal to be inserted. The positions of contact points with the male terminal 12, 94 may be clarified by forming embossed parts projecting at arbitrary positions on the inner surface 28 of the male terminal inserting tube portion 26, 56, 70, 82, 88, 92, 102 having an arbitrary shape.

Furthermore, although the circumferential positions of the second divided portions 58, 104 are positions facing the first divided portions 29 in an axially perpendicular direction in the second to seventh embodiments, there is no limitation to this. For example, the first divided portions 29 and the second divided portions 58, 104 may be provided at positions separated by 90° in the circumferential direction and the overlapping plate portions 25*a*, 25*b* and the extending plate portions 60, 106 may project in orthogonal directions. In this way, a degree of freedom in designing the female terminal 52, 62, 76, 86, 90 can be improved.

The invention claimed is:

1. A female terminal, comprising:

a female terminal fitting including a connector to be conductively connected to a male terminal;

a male terminal inserting tube provided in the female terminal fitting, the male terminal being press-fit into the male terminal inserting tube, the male terminal inserting tube forming the connector by an inner surface;

a pair of overlapping plates connected to a pair of first divided portions provided by dividing the male terminal inserting tube over an entire length in an axial direction at one position in a circumferential direction, the pair of overlapping plates being separated from each other and projecting outward; and a spring held on the female terminal fitting, the spring holding the male terminal inserting tube in a reduced diameter state by biasing the pair of overlapping plates in a direction to overlap the pair of overlapping plates on each other, a force in a diameter reducing direction being applied to the male terminal inserting tube by a biasing force of the spring, and the male terminal inserting tube being resiliently deformed in a diameter expanding direction against the biasing force of the spring to allow the male terminal to be press-fit into the male terminal inserting tube when the male terminal is press-fit into the male terminal inserting tube.

2. The female terminal of claim 1, wherein the male terminal inserting tube has a rhombic cross-sectional shape.

3. The female terminal of claim 1, wherein the inner surface of the male terminal inserting tube is formed into a tapered shape to gradually reduce a diameter toward a tip side in a press-fitting direction of the male terminal.

4. The female terminal of claim 1, wherein:

the female terminal fitting further includes a pair of extending plates connected to the pair of first divided portions and extending further outward from projecting end parts of the pair of overlapping plates, and the pair of extending plates are overlapped on each other to configure a wire connector, and second divided portions extending over the entire length in the axial direction are provided at another position in the circumferential direction of the male terminal inserting tube.

5. The female terminal of claim 1, further comprising a case assembled with the female terminal fitting and having an accommodation space, the accommodation space being disposed above the overlapping plates, wherein:

the spring is held on the female terminal fitting by being accommodated into the accommodation space of the case, and the spring is held in a compressed state between the overlapping plates and a facing wall of the case facing the overlapping plates.

6. The female terminal of claim 1, wherein the spring includes a coil spring.

7. The female terminal of claim 1, wherein the female terminal fitting includes a strip-like flat metal plate, one end part in a longitudinal direction of the flat metal plate forming one of the pair of overlapping plates is folded toward another end part and overlapped on the other of the pair of overlapping plates provided on a side of the other end part, whereby an intermediate part in the longitudinal direction of the flat metal plate is curved to provide the male terminal inserting tube.

8. The female terminal of claim 7, wherein the other end part of the flat metal plate forming the female terminal fitting serves as a wire connector, and the spring for biasing the pair of overlapping plates in an approaching direction is disposed and held between the wire connector and the male terminal inserting tube.

9. The female terminal of claim 1, wherein the female terminal fitting further includes second divided portions extending over an entire length in the axial direction and a pair of extending plates connected to the second divided portions and projecting outward at another position in the circumferential direction of the male terminal inserting tube, and the pair of extending plates are overlapped on each other to configure a wire connector.

10. The female terminal of claim 9, wherein the male terminal inserting tube is provided between the wire connector and the pair of overlapping plates in a longitudinal direction of the female terminal fitting.

11. The female terminal of claim 9, wherein:

the female terminal fitting includes a first plate fitting integrally configuring one of the pair of overlapping plates connected to one of the first divided portions, a peripheral wall of the male terminal extending from the one of the first divided portions to one of second divided portions and one of the extending plates extending from the one of the second divided portions, and a second plate fitting including the other of the pair of overlapping plates connected to the other of the first divided portions, the peripheral wall of the male terminal inserting tube extending from the other of the first divided portions to the other of the second divided portions and the other of the extending plates extending from the other of the second divided portions, the first and second plate fittings are overlapped on each other to configure the male terminal inserting tube in central parts in the longitudinal direction of the first and second plate fittings, the wire connector is configured on a base end side in the longitudinal direction, and the spring for overlapping the pair of overlapping plates on each other and biasing the pair of overlapping plates is provided on a tip side in the longitudinal direction, and plate thicknesses of the first and second plate fittings are different from each other.

12. The female terminal of claim 11, wherein the first plate fitting is in the form of a flat plate, the second plate fitting to be overlapped on the first plate fitting is configured such that both end parts in the longitudinal direction are in the form of flat plates and a central part in the longitudinal direction includes a convex portion forming the peripheral wall of the male terminal inserting tube, having a convex cross-section convex in a direction separating from the first plate fitting and projecting along a plate width direction, and the first plate fitting has a larger plate thickness than the second plate fitting.

13. The female terminal of claim 11, wherein the first plate fitting is in the form of a flat plate, the second plate fitting to be overlapped on the first plate fitting is configured such that both end parts in the longitudinal direction are in the form of flat plates and a central part in the longitudinal direction includes a convex portion forming the peripheral wall of the male terminal inserting tube, having a convex cross-section convex in a direction separating from the first plate fitting and projecting along a plate width direction, and the first plate fitting has a smaller plate thickness than the second plate fitting.

* * * * *